US008327906B2

(12) United States Patent
Kwak

(10) Patent No.: US 8,327,906 B2
(45) Date of Patent: Dec. 11, 2012

(54) TILTABLE DOUBLE-LAYERED FABRIC BLIND

(76) Inventor: Jae-Suk Kwak, Gyeonggi-do (KR)

( * ) Notice: Subject to any disclaimer, the term of this patent is extended or adjusted under 35 U.S.C. 154(b) by 0 days.

(21) Appl. No.: 12/746,142

(22) PCT Filed: Feb. 16, 2010

(86) PCT No.: PCT/KR2010/000936

§ 371 (c)(1),
(2), (4) Date: Jun. 3, 2010

(87) PCT Pub. No.: WO2011/065626

PCT Pub. Date: Jun. 3, 2011

(65) Prior Publication Data

US 2012/0222828 A1 Sep. 6, 2012

(30) Foreign Application Priority Data

Nov. 28, 2009 (KR) ..... 10-2009-0116267

(51) Int. Cl.
*E06B 9/08* (2006.01)

(52) U.S. Cl. ..... 160/121.1; 160/84.05

(58) Field of Classification Search ..... 160/121.1, 160/84.05, DIG. 11, 84.01, 84.04, 176.1 R, 160/321

See application file for complete search history.

(56) References Cited

U.S. PATENT DOCUMENTS

| | | | | |
|---|---|---|---|---|
| 2,280,358 | A * | 4/1942 | Tietig | 160/120 |
| 3,854,517 | A * | 12/1974 | Nakamura | 160/323.1 |
| 4,019,554 | A * | 4/1977 | Rasmussen | 160/84.02 |
| 4,187,896 | A * | 2/1980 | Shore | 160/121.1 |
| 4,194,550 | A * | 3/1980 | Hopper | 160/121.1 |
| 4,453,584 | A * | 6/1984 | Steele | 160/121.1 |
| 5,855,235 | A * | 1/1999 | Colson et al. | 160/121.1 |
| 7,059,378 | B2 * | 6/2006 | Colson et al. | 160/121.1 |
| 7,267,156 | B2 * | 9/2007 | Byeon | 160/121.1 |
| 8,191,605 | B2 * | 6/2012 | Kwak | 160/319 |

* cited by examiner

*Primary Examiner* — David Purol
(74) *Attorney, Agent, or Firm* — Levine & Mandelbaum

(57) ABSTRACT

A tiltable double-layered fabric blind is provided, which includes a double-layered fabric, composed of transparent front and rear sheets and a plurality of opaque spacer veins, with a horizontal bar mounted to a lower end of the fabric, a rotator having a coupling pipe and a driving body mounted to one side of the coupling pipe, the coupling pipe being combined with the double-layered fabric, an angle regulator having a rotating pipe and a rotating body, the rotating pipe having a friction member, which makes one layer of the double-layered fabric brought into close contact with the circumference thereof, a connection plate having a protrusion, which is coupled through the rotator and the angle regulator, and control cords mounted on one side of the rotator and the angle regulator.

3 Claims, 11 Drawing Sheets

TILTABLE DOUBLE-LAYERED FABRIC BLIND

CROSS-REFERENCE TO RELATED APPLICATIONS

This application claims all benefits of Korean Patent Application No. 10-2009-116267 filed on Nov. 28, 2009 in the Korean Intellectual Property Office, the disclosures of which are incorporated herein by reference.

BACKGROUND OF THE INVENTION

1. Field of the Invention

The present invention relates, in general, to a blind capable of tilting double-layered fabrics and, more particularly, to a tiltable double-layered fabric blind, wherein compared to a double-layered fabric blind of the prior art, in which only upon pulling down double-layered fabrics to the end, the double-layered fabrics can be open, spacer veins that are connected between two layers of fabrics can be freely pivoted at a desired angle at a position where a user wants, so that the double-layered fabrics are controlled to be tiltable at any position, thereby improving the convenience of use.

Moreover, even though the length of the double-layered fabrics is different from that of a window, the blind can be installed so that the double-layered fabrics can be opened and closed at any position, providing excellent adaptability and compatibility to various kinds of windows irrespective of the sizes thereof.

2. Description of the Related Art

Generally, a roller blind is configured such that the amounts of incident sunlight and open view through a window are controlled by the extent that blind fabrics are wound around a winding rod, so that the roller blind has a problem in that when the blind fabrics are pulled down to the end, the transmission of sunlight and open view through a window are completely intercepted.

To solve this problem, as shown in FIGS. 1 and 2, there has been proposed a roller blind using double-layered fabrics 4, wherein the double-layered fabrics 4 consist of front and rear net-woven sheets 1 and 2 and a plurality of spacer veins 3 disposed between the front and rear sheets 1 and 2.

The spacer veins 3 each have a shape of a letter of substantially "S" in section and are horizontally connected between the front and rear sheets 1 and 2 so as to separate the sheets at a distance.

The front and rear sheets 1 and 2 are composed of transparent net-woven material, and the spacer veins 3 of translucent material that is more flexible than those of the front and rear sheets 1 and 2.

The double-layered fabrics 4 are configured such that external light is introduced inside through the front and rear sheets 1 and 2 while the spacer veins 3 are stretched and assume a horizontal posture.

Further, as shown in FIG. 2, when one side of the front or rear sheet 1 or 2 is lifted up, the stretched veins 3 become folded so that the front and rear sheets 1 and 2 are substantially brought into contact with each other and the spacer veins 3 are connected to each other, thereby coming into the translucent state in which light is transmitted through the front and rear sheets 1 and 2, but vision is blocked.

As shown in FIG. 3, there is provided a roller blind 9 that is fabricated using the double-layered fabrics 4.

The roller blind 9 includes an upper case 6 to which a winding rod 5 is coupled, around which the double-layered fabrics 4 are wound, and a lower weight bar 7 which is mounted to a lower end of the double-layered fabrics.

The roller blind further includes a drive roller 8 which is mounted to one end of the winding rod 5 so as to move the double-layered fabrics up and down, and a control cord 8*a* which rotates the drive roller 8.

In use, when the control cord 8*a* is pulled down in an arrow direction, the drive roller 8 is rotated and thus the double-layered fabrics 4 are pulled down.

Here, the spacer veins 3, which have been provided between the front and rear sheets 1 and 2, are in a folded state as shown in FIG. 2, and when the double-layered fabrics are moved to the end, the veins 3 are then unfolded and stretched by the weight of the lower weight bar 7.

That is, the conventional roller blind is operated such that only when the double-layered fabrics are pulled down to the end, plural veins become stretched by the weight of the lower weight bar, thereby causing a problem in that there is no means that a user can stretch the folded veins at a desired position, or any position where the fabrics are pulled down, and that can control an angle at which the veins are stretched.

Furthermore, since the double-layered fabrics wound around the drive roller should be pulled down to the end in order to open the double-layered fabrics, and the whole length of the roller blind should be equal to the length of a window where the blind will be installed, a product should be fabricated by the size suitable for various kinds of windows, causing a problem of reduction in economical efficiency and compatibility.

SUMMARY OF THE INVENTION

Accordingly, the present invention has been made keeping in mind the above problems occurring in the related art, and the present invention is intended to propose a tiltable double-layered fabrics blind n which double-layered fabrics wound around a coupling pipe can be drawn up through a friction member (with friction coefficient) formed on a full circle of an angle regulator such that one side of the double-layered fabrics is brought into close contact with the friction member at any time and point, and is drawn up in a direction toward which a rotating pipe rotates, thereby making spacer veins of the double-layered fabrics stretched at a desired angle at a desired position.

Another object is to provide a tiltable double-layered fabric blind in which an angle regulator is made thinner and smaller than a rotator so that the blind can be mounted to a window with less mounting space.

In order to achieve the above objects, according to one aspect of the present invention, there is provided a tiltable double-layered fabric blind including: a double-layered fabric, composed of transparent front and rear sheets and a plurality of opaque spacer veins having a letter of "S" in section, with a horizontal bar mounted to a lower end of the fabric; a rotator having a coupling pipe and a driving body mounted to one side of the coupling pipe, the coupling pipe being formed with a cylindrical pipe and combined with the double-layered fabric in such a manner that the spacer veins of the double-layered fabric are stretched in a horizontal posture and upper ends of the front and rear sheets are fixedly attached to opposite sides of the circumference of the coupling pipe; an angle regulator having a rotating pipe mounted behind the rotator and a rotating body mounted to one side of the rotating pipe, the rotating pipe having a friction member, which makes one layer of the double-layered fabric brought into close contact with the circumference thereof and draws up the one layer; a connection plate having a protrusion, which is coupled to center holes of the rotator and the angle regulator; and control cords mounted on one side of the rotator and the angle regulator.

According to the above construction of the present invention, the tiltable double-layered fabric blind has the following effects.

First, the spacer veins of the double-layered fabric can be freely stretched at a desired angle at any desired position without pulling down the double-layered fabric to the end, having the effect of providing ease of use.

Second, the double-layered fabric blind can be adapted to various kinds of windows, providing excellent compatibility.

Third, the angle regulator is made thinner and smaller so that the tiltable double-layered fabric blind can be simply mounted without restrictions.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Figure 1:
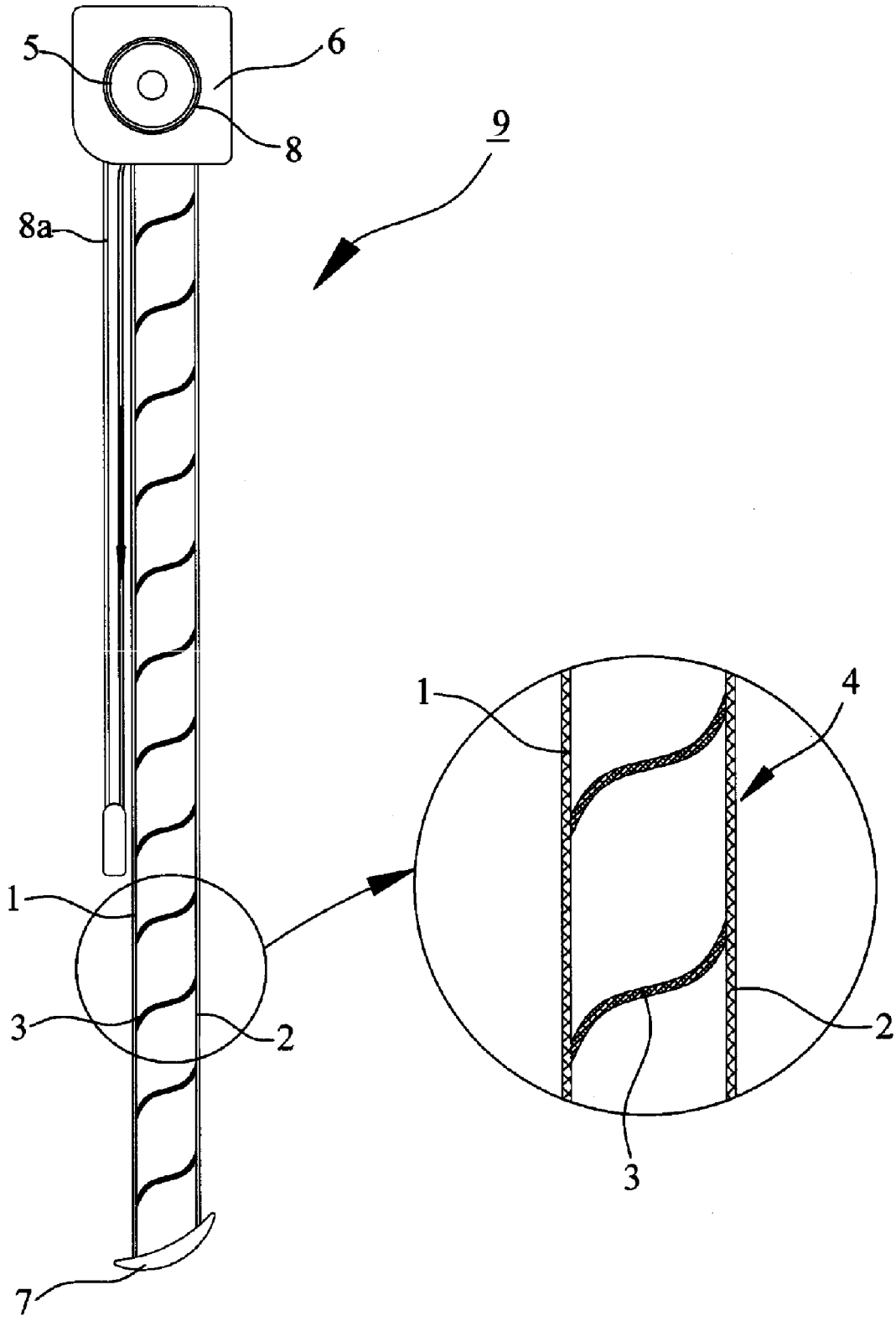
FIGS. 1 to 3 are cross-sectional views of a double-layered fabric blind according to the prior art.
Figure 2:
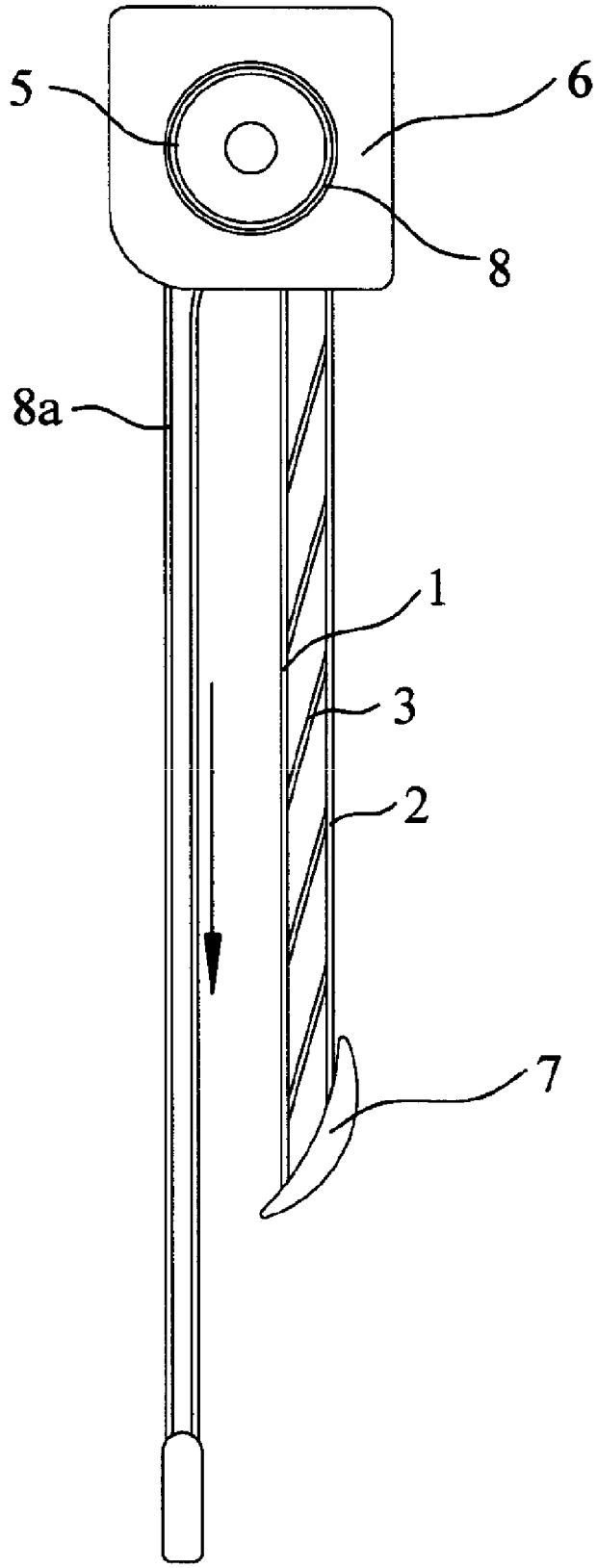
Figure 3:
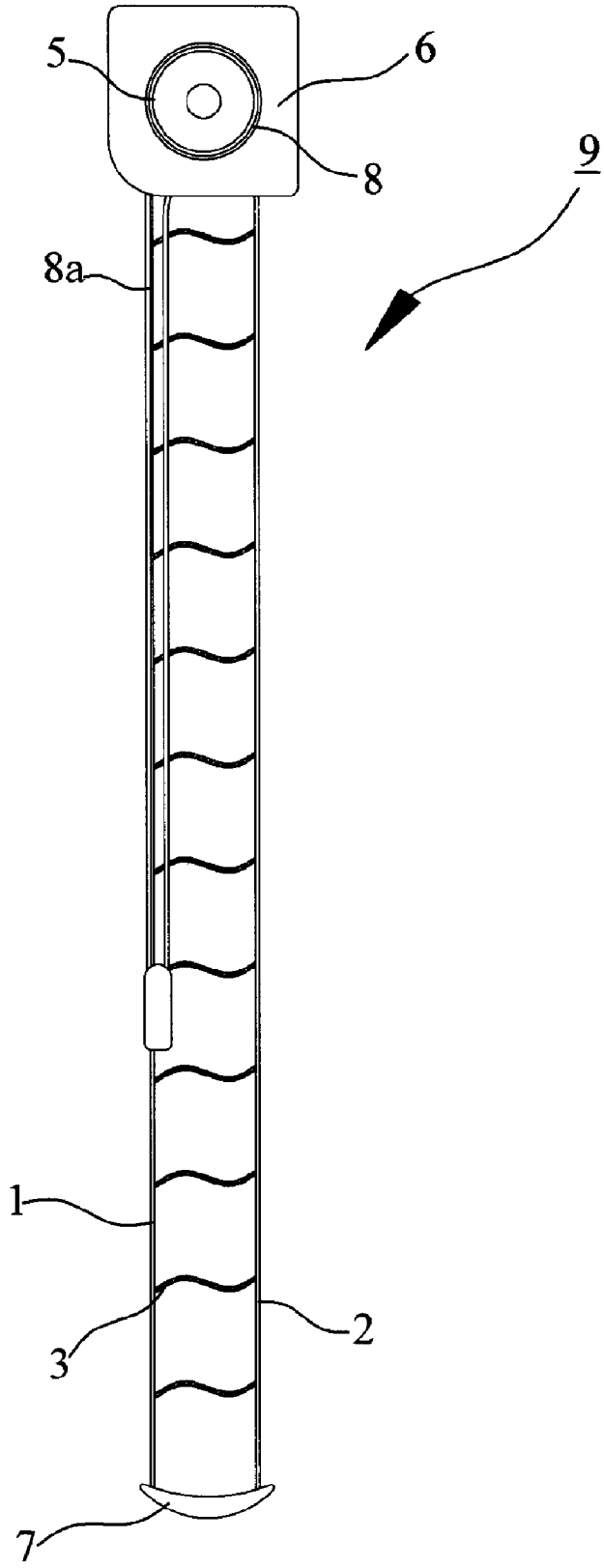

Reference will now be made in greater detail to a preferred embodiment of the invention, an example of which is illustrated in the accompanying drawings. Wherever possible, the same reference numerals will be used throughout the drawings and the description to refer to the same or like parts.

Figure 4:
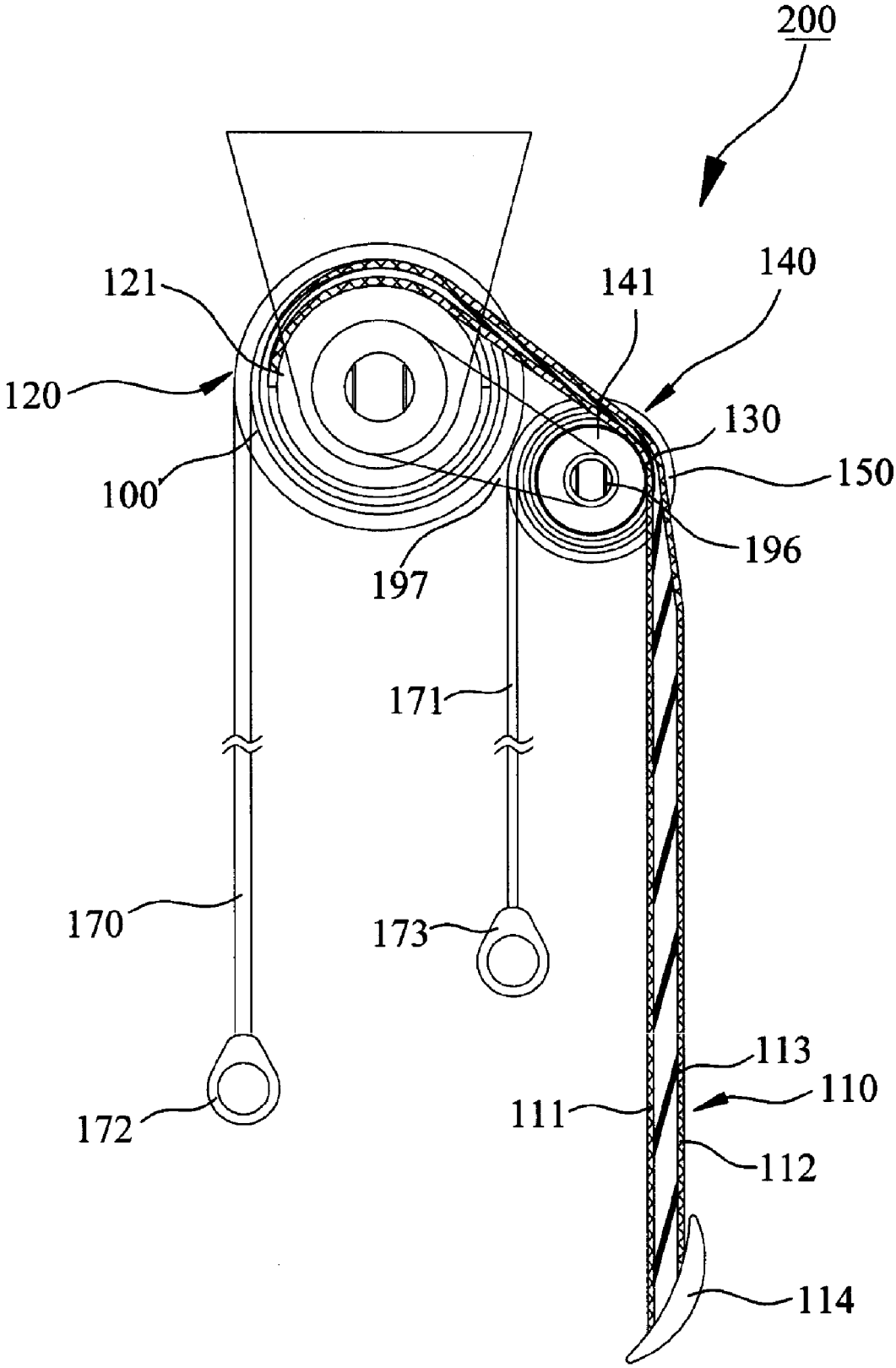
FIG. 4 is a cross-sectional view of a tiltable double-layered fabric blind according to the present invention.
Figure 5:
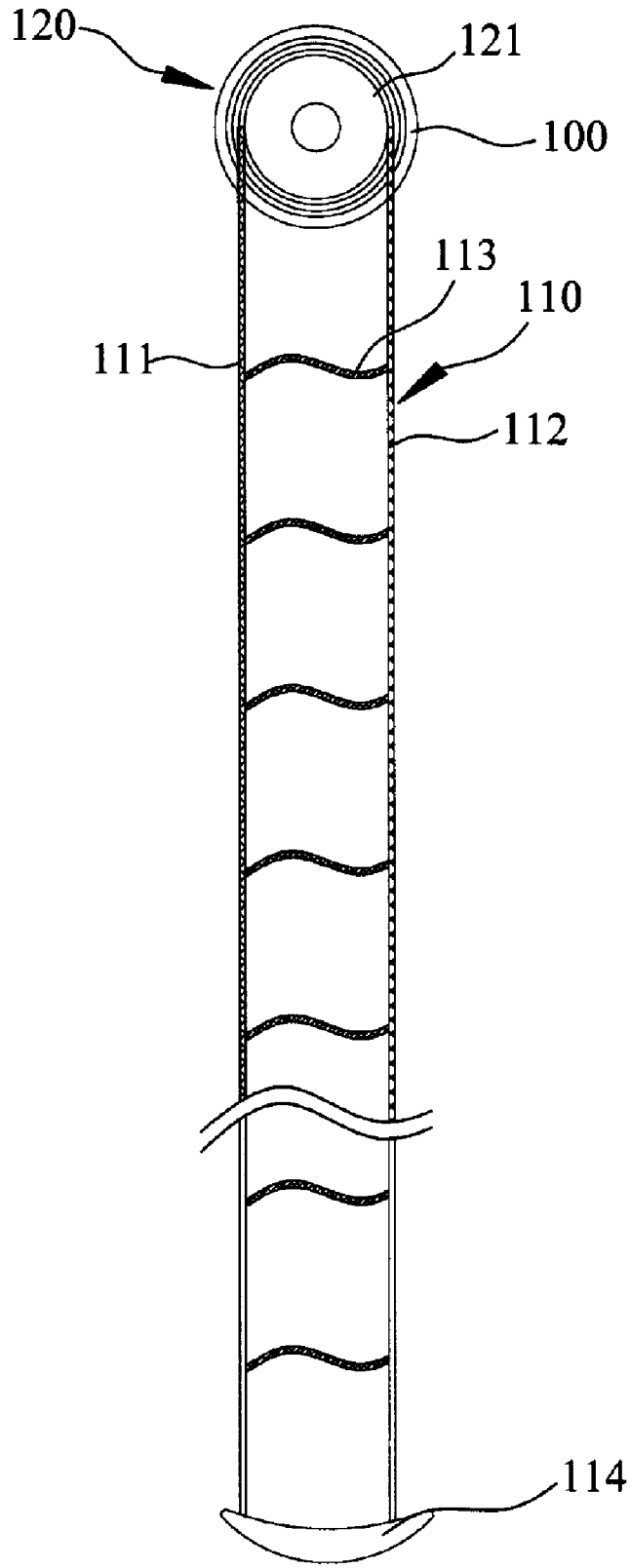
FIG. 5 is a cross-sectional view of the installed state of the double-layered fabric according to the present invention.
Figure 6:
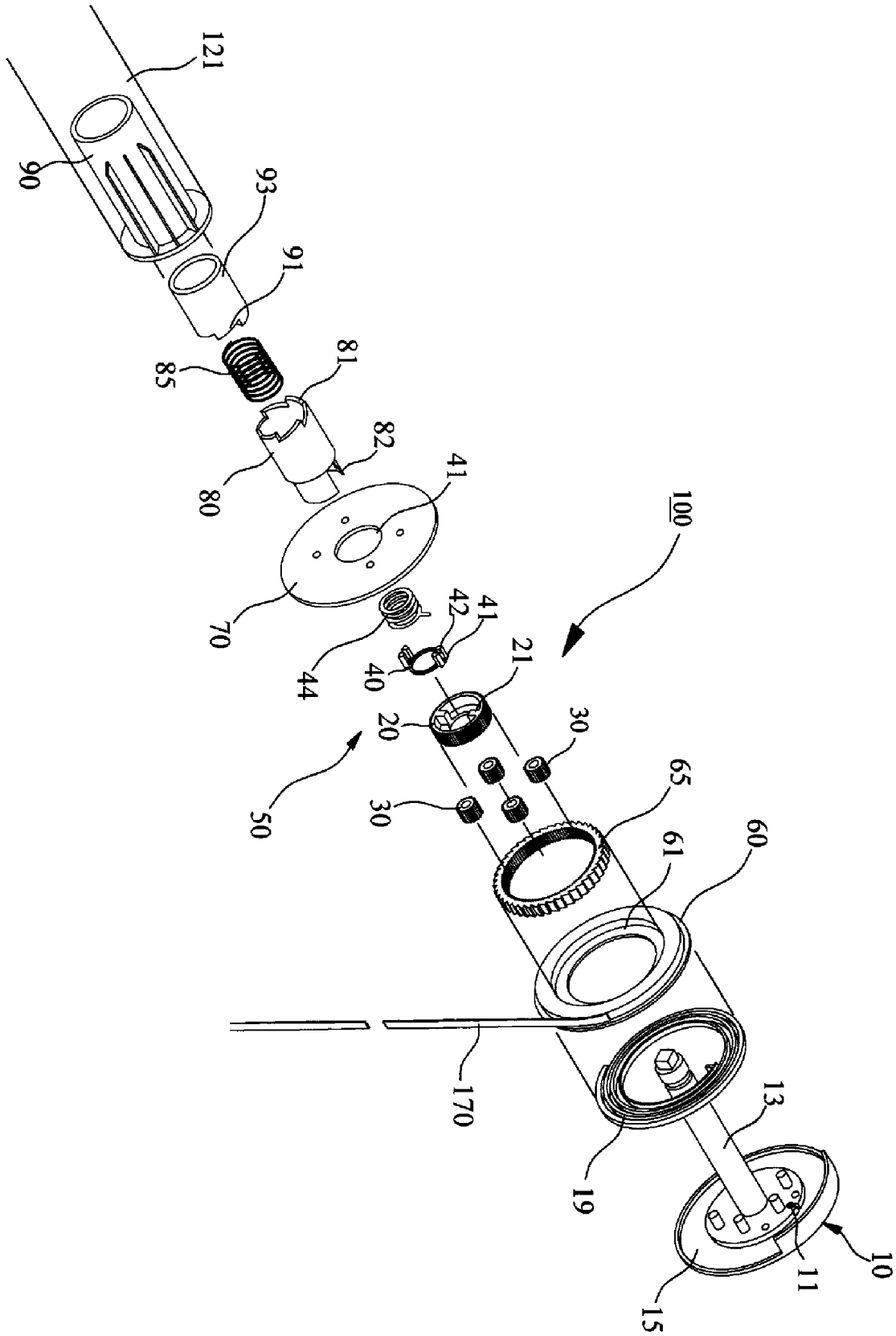
FIG. 6 is an exploded perspective view of the whole construction of a driving body according to the present invention.
Figure 7:
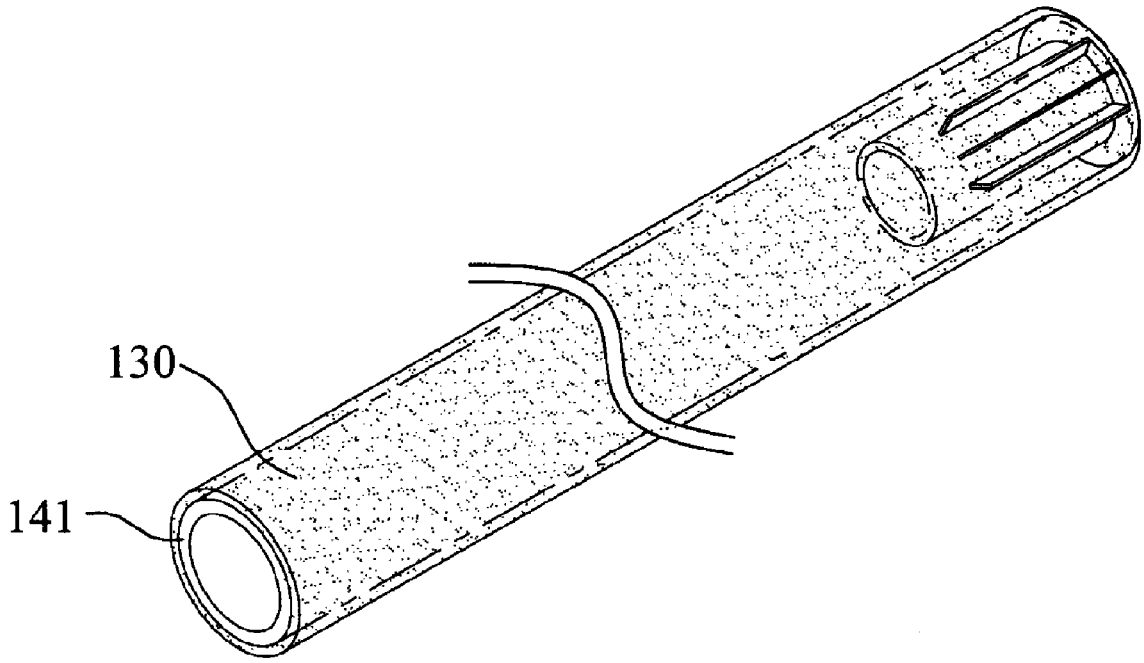
FIG. 7 is a perspective view of the construction of a friction member according to the present invention.
Figure 8:
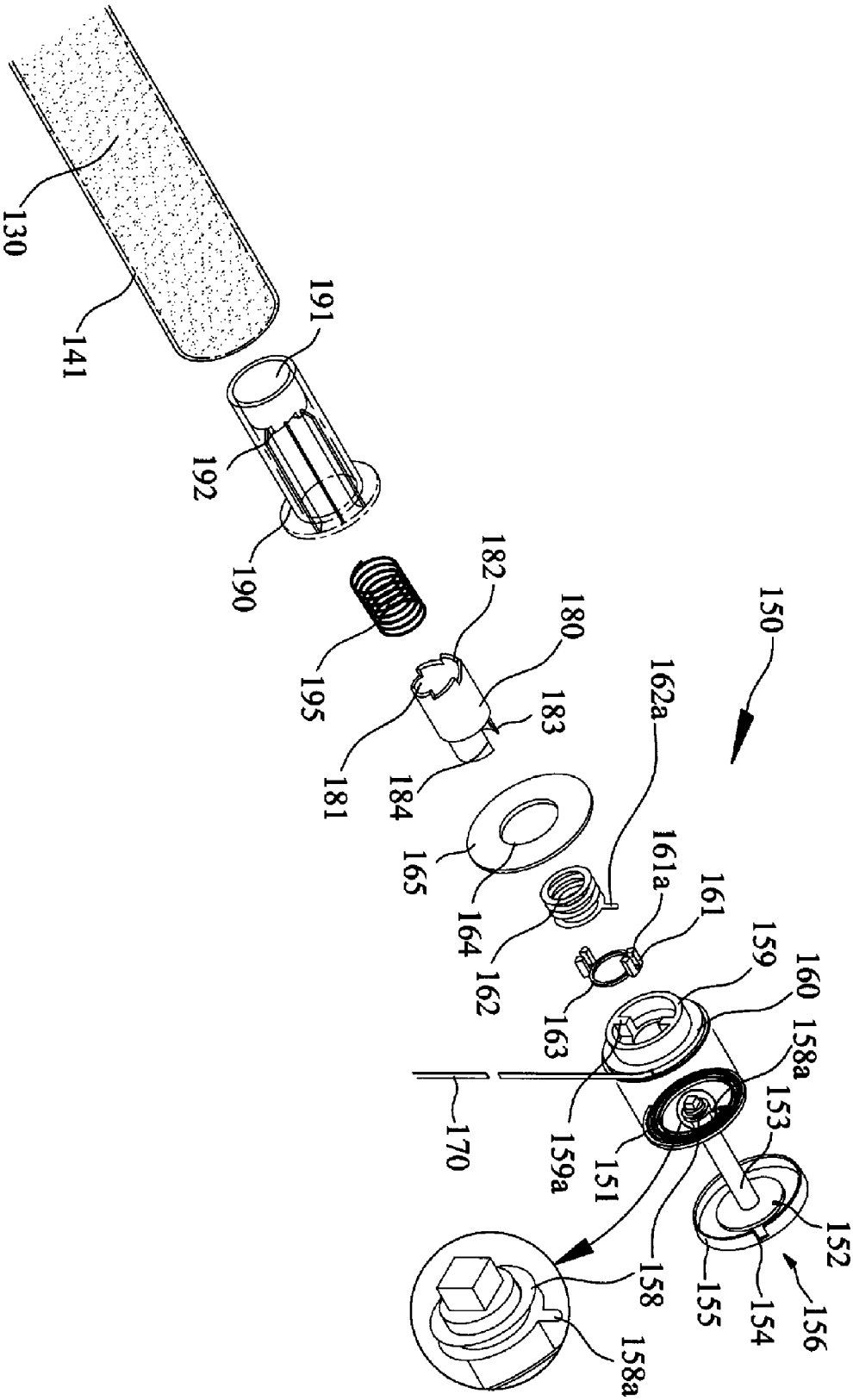
FIG. 8 is an exploded perspective view of the construction of a rotating body according to the present invention.
Figure 9:
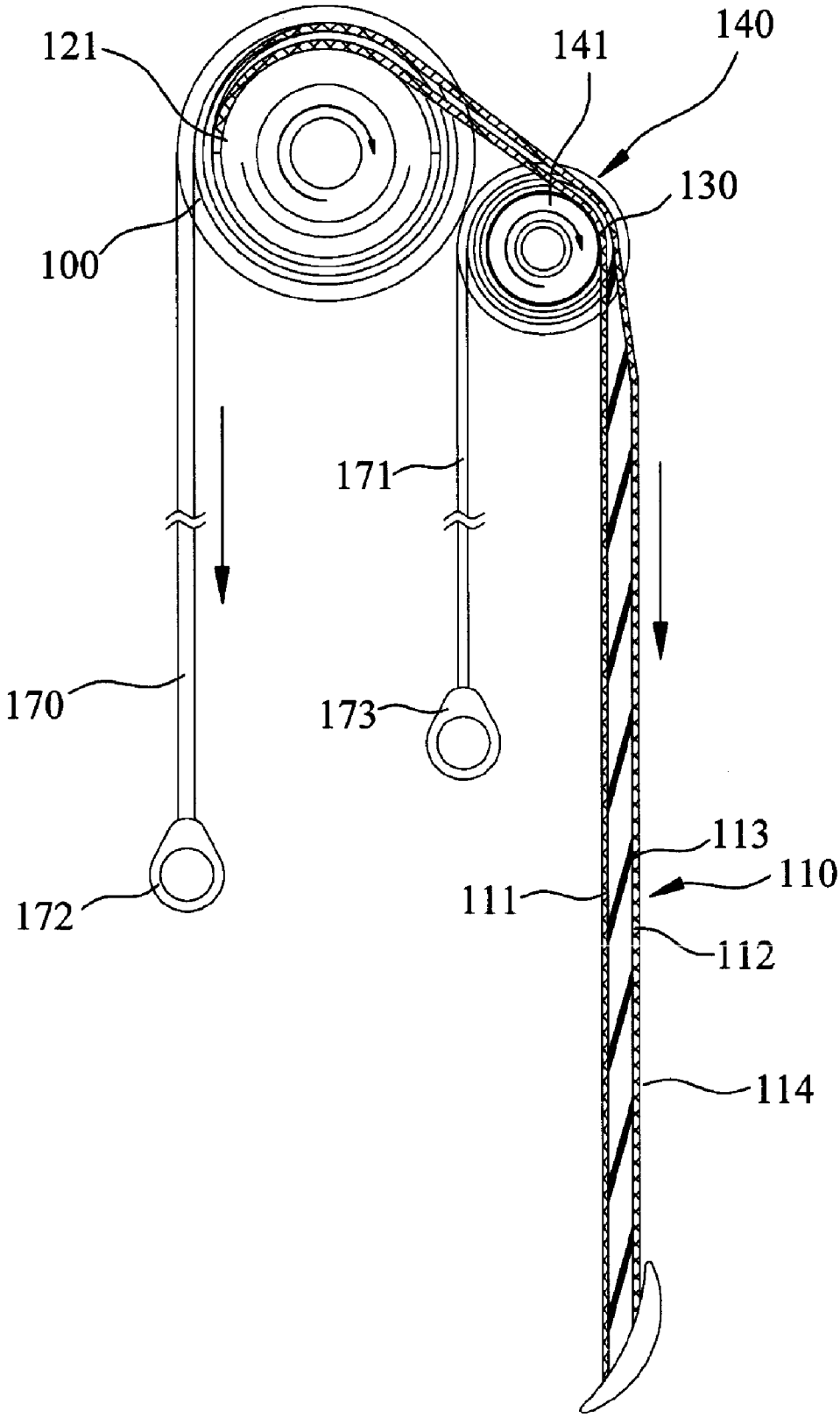
FIGS. 9 to 11 are views of the used state of the tiltable double-layered fabric blind according to the present invention.
Figure 10:
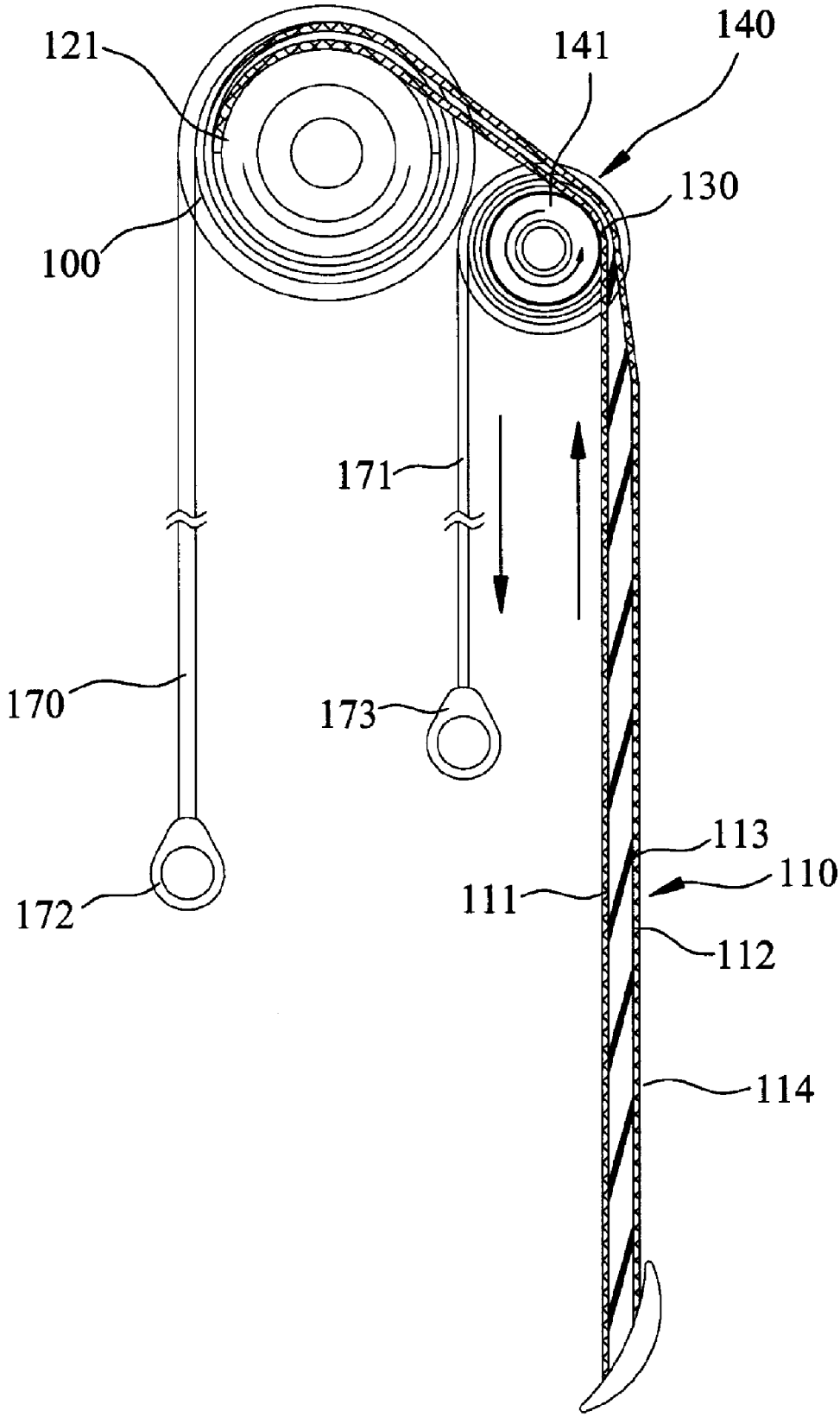
Figure 11:
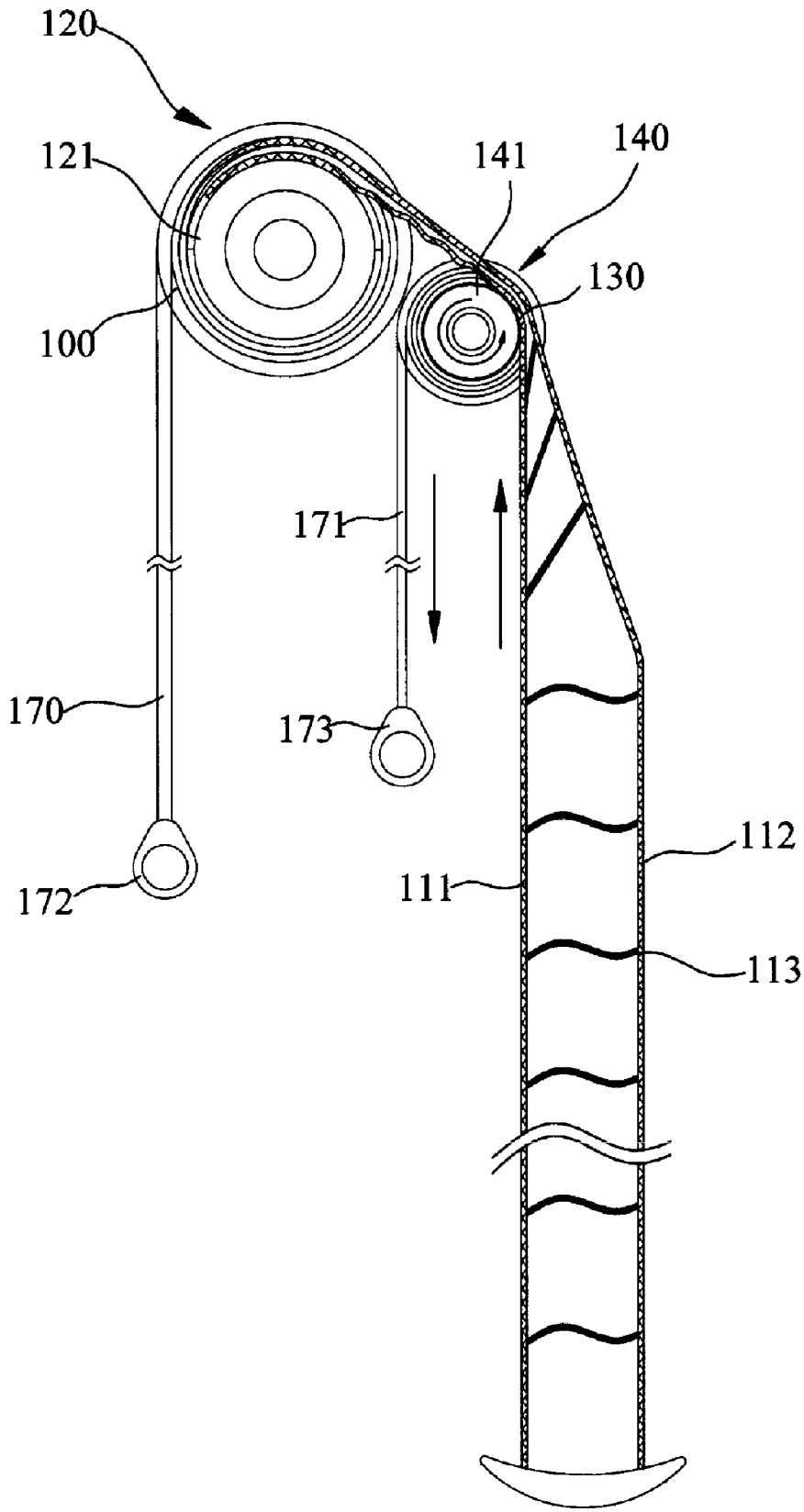

FIG. 4 is a cross-sectional view of a tiltable double-layered fabric blind according to the present invention, FIG. 5 is a cross-sectional view of the installed state of the double-layered fabric according to the present invention, FIG. 6 is an exploded perspective view of the whole construction of a driving body according to the present invention, FIG. 7 is a perspective view of the construction of a friction member according to the present invention, FIG. 8 is an exploded perspective view of the construction of a rotating body according to the present invention, and FIGS. 9 to 11 are views of the used state of the tiltable double-layered fabric blind according to the present invention.

Reference numeral 200 denotes a main body of the tiltable double-layered fabric blind according to the present invention.

The main body 200 includes a rotator 120 having a coupling pipe 121, around which a double-layered fabric 110 is wound, an angle regulator 140 having a friction member 130, which allows one layer of the double-layered fabric 110 to be brought into close contact with the circumference thereof and draws up the layer, a connection plate 197 connecting the rotator 120 and the angle regulator 140, and control cords 170 and 171 controlling a height and an angle, respectively, of the double-layered fabric 110.

The double-layered fabric 110 consists of net-type transparent front and rear sheets 111 and 112 and a plurality of spacer veins 113 disposed between the front and rear sheets 111 and 112 each having a shape of a letter of "S" in section.

A horizontal bar 114 is mounted on a lower end of the double-layered fabric 110.

The rotator 120 consists of a coupling pipe 121, around which the double-layered fabric 110 is coupled, and a driving body 100 mounted to one side of the coupling pipe 121.

The coupling pipe 121 is formed with a cylindrical pipe and combined with the double-layered fabric in such a manner that as shown in FIG. 5, the spacer veins 113 of the double-layered fabric 110 are stretched in a horizontal posture and an upper ends of the front and rear sheets 111 and 112 are fixedly attached to opposite sides of the circumference of the coupling pipe.

In this way, the front sheet 111 of the double-layered fabric 110, which is wound around the coupling pipe 121, is then mounted so as to come closer to the circumference of a rotating pipe 141.

The driving body 100 adopts the operating principle of a 'one cord blind' disclosed in the Applicant's prior Korean Patent Registration No. 875633, wherein the driving body includes a fixing plate 15 having a shaft 13 with a fixing hole 11 to which a leaf spring 19 is coupled.

There is further a gear body 50, which consists of an inner gear 20, small-diameter gears 30, and a fixing ring 40 to which a spring is mounted.

The gear body 50 is engaged with inside of a rotating gear 65, the rotating gear being provided with internal and external gear teeth on inner and outer circumferences, and the rotating gear 65 is inserted and mounted into a coupling groove 61 of an operating plate 60, around which a control cord 170 is coupled.

A cover plate 70 is fixedly mounted to the front side of the operating plate 60 in order to prevent the gear body 50 and the control cord 170 from being detached outside.

A carrier 80 is coupled into a hole 71 of the cover plate 70. The carrier couples and decouples the cover 90 while being screw-coupled with a rotating section 93 of a cover 90.

The coupling pipe 121, around which the double-layered fabric 110 is attached, is inserted and mounted around the circumference of the cover 90.

The operating body 100 is operated such that, when the control cord 170 is pulled down, the operating plate 60 is rotated and the rotating gear 65 is rotated in the same direction as the operating plate 60.

Then, the plurality of small-diameter gears 30 screwed inside the rotating gear 65 is also rotated in the same direction so that the inner gear 20, which has been engaged with the small-diameter gears 30, is rotated in the counter direction from the small-diameter gear 30.

Then the carrier 80, which has come into contact with a reinforcing step 21 of the inner gear 20, is rotated so that a fixing step 41 of the fixing ring 40 is moved along an inclined surface 82 of the carrier 80 so as to advance the carrier 80.

Here, an elastic spring 85 is compressed and a screw portion 81 of the carrier 80 is engaged with a screw portion 91 of the rotating section 93, which has been mounted inside the cover, so as to rotate the cover 90, together with the coupling pipe 1212 mounted around the cover 90.

The angle regulator 140 includes the rotating pipe 141 formed with the friction member 130, and the rotating body 150 arranged at one side of the rotating pipe 141.

The angle regulator 140 has the diameter ⅓ times the diameter of the rotator 120, which is mounted before the angle regulator, and is mounted after and below the rotator 120.

The rotating pipe 141 is provided with the friction member 130 (for preventing slippage), which as shown in FIG. 7, comes into close contact with one layer of the double-layered fabric 110 and draws up the fabric so that the spacer veins 113 of the double-layered fabric 110 are stretched and regulated at a certain angle.

The friction member 130 is configured such that the outer circumference of the rotating pipe 141 is directly applied or coated with silicone liquid or rubber-like member, to which the front sheet 111 of the double-layered fabric 110 closely adheres.

The friction coefficient of the silicone liquid or rubber member, used in the friction member 130, can be controlled according to the width of the double-layered fabric 110 and the length of fabric wound.

The friction member 130 is operated so that in the state of coming into close contact with the front sheet 111 of the double-layered fabric 110, if the rotating pipe 141 is rotated, the friction member draws up the front sheet 111 without slippage.

When only the front sheet 111 of the double-layered fabric 110 is moved upwards as such, the folded veins 113 become stretched at a desired angle.

Compared to the prior art, means for adhering one layer of the double-layered fabric 110 thereto and drawing up the same is a newly contrived device, which facilitates folding and unfolding of the double-layered fabric 110 and easy angle-controlling.

Moreover, the double-layered fabric 110 can be freely stretched at any desired position without the need for pulling-down of the fabric to the end.

The rotating body 150 is mounted on one side of the rotating pipe 141 in order to rotate the rotating pipe 141.

When the rotator 120 installed before the rotating body 150 is rotated and opens and closes the double-layered fabric 110, the rotating body 150 is in a free rotating state, so that the rotating body does not hinder the rotation of the rotator 120, but is rotated in the same direction as the rotator 120, thereby allowing smooth opening and closing of the double-layered fabric 110.

The rotating body 150 includes a fixing body 156 having a fixing hole 152 provided on one outer surface, to which a leaf spring 151 is fixedly mounted, a center fixing protrusion shaft 153 and a guide plate 155, in which a control cord outlet hole 154 is formed thereon.

Here, a spring 158 having an engaging step 158*a* is mounted on the outer circumference of a leading end of the fixing protrusion shaft 153.

The spring 158 is coupled into a coupling groove 184 of a carrier 180 such that the engaging step 158*a* comes into close contact with one side of the coupling groove 184, thereby preventing the carrier 180 from freely rotating.

An operating plate 160 is inserted into and mounted inside the guide plate 155 of the fixing body 156, wherein the control cord 170 is wound around the outer circumference of the operating plate, and a fastening portion 159, reinforcing steps 159*a* of which are symmetrically formed on an inner circumference thereof, is integrally formed on a front surface of the operating plate.

Here, the control cord 170 passes through the outlet hole 1554 to the outside.

A fixing ring 163 that has opposite fixing steps 161 with cut recesses 161*a*, respectively, is coupled around the outer circumference of the fastening portion 159, an engaging step 162*a* of a spring 162 being fitted into the cut recess 161*a* of the fixing ring 163.

A circular cover plate 165 with a center hole 164 is fixedly installed on the front surface of the operating plate 160.

Into the center hole 164 of the cover plate 165, the carrier 180 is inserted, which has a center insertion hole 181, through which the fixing protrusion shaft 153 is inserted, a gear 182 provided on the front surface, and a coupling groove 184 provided on the rear surface with an inclined surface 183 formed on one side.

Here, the engaging step 161 of the fixing ring 163 is in contact with the coupling groove 184 of the carrier 180.

The gear 182 formed on the front surface of the carrier 180 is engaged with a cover 190, in which a compression spring 195 is mounted into an insertion hole 191 and a gear 192 is formed on the frontal inner circumference, so that the carrier is rotated in the same direction as the cover.

On the cover 195, the rotating pipe 141 having the friction member 130 is installed.

In operation of the rotating body 150, when the control cord 170 that is attached to the operating plate 160 is held and pulled down, the fastening portion 159 of the operating plate 160 is thus rotated.

The spring 158 that is installed in the coupling groove 184 of the carrier 180 resiliently urges the carrier 180 to advance without rotating.

Here, the fixing steps 161 of the fixing ring 163 is moved upwards along the inclined surface 183 of the carrier 180 and moves the carrier forwards.

Then, the compression spring 195 is compressed and the gear 182 formed on the front side of the carrier 180 is engaged with the gear 192 of the cover 190 so that the cover 190 is rotated.

Contrary to this, if the gear 182 of the carrier 180 becomes separated from the gear 192 of the cover 190, the cover 190 becomes an initial state, i.e. a free-rotation state.

The initial state is maintained when the rotator 120 on the front side is rotated, so that it does not influence the opening and closing operation of the double-layered fabric 110.

The rotator 120 and the angle regulator 140 are connected each other by a connection plate 197.

The connection plate 197 is made of metal and provided on opposite sides with coupling protrusions 196, each being fitted into the center holes of the rotator 120 and the angle regulator 140.

The control cords 170 and 171 are provided in the operating plate 60 of the driving body 100 and the operating plate 160 of the rotating body 150, respectively, and have holding rings 172 and 173 on the lower portion thereof.

If necessary, separate wires are tied to the respective holding rings 172 and 173 of the control cords 170 and 171, so that they can be used as a grip.

The operation of the present invention will now be explained with reference to the accompanying drawings.

As shown in FIGS. 9 and 11, when the control cord 170 provided in the rotator 120 is pulled down, the rotator 120, around which the double-layered fabric 110 is wound, is rotated in an arrow direction.

Then, the angle regulator 140 before the rotator is also rotated in the same direction, so that the double-layered fabric 110 is moved down.

Here, the double-layered fabric 110 is kept in a state of the veins 113 between the front sheet 111 and the rear sheet 112 being folded.

Then, if the double-layered fabric 110 is pulled down to a user's desired position and the user wants external light transmitted inside at that position, the user pulls down the control cord 171 provided in the operating plate 160 of the rotating body 150.

Then, when the fastening portion 159 of the operating plate 160 is rotated and the spring 158, which is mounted in the coupling groove 184 of the carrier 180, urges the carrier 180 to advance without rotating, the carrier 180 is moved forwards while the fixing step 161 of the fixing ring 163 is moved up along the inclined surface 183 of the carrier 180.

Here, the gear 182 of the carrier 180 and the gear 192 of the cover 190 are engaged with each other with elasticity of the compression spring 195, so as to rotate the rotating pipe 141.

Then friction member 130 that is formed on the whole outer surface of the rotating pipe 141 allows the front sheet 111 of the double-layered fabric 110 to come closer to the friction member so that the friction member enables the fabric to be drawn up in the same direction as the rotation of the rotating pipe 141 without slippage.

Here, while the front sheet 111 is drawn up, the veins 113, which have been folded between the front sheet 111 and the rear sheet 112, become stretched, so that external light is transmitted inside through both the front sheet 111 and the rear sheet 112, which are transparent.

Further, the front sheet 111 adhered to the friction member 130 is drawn up in a folded state.

As such, a user can easily regulate an angle of the double-layered fabric 110 at any position while rotating the angle regulator 140.

In this state, if the control cord 171 is pulled down again and then released, the compression spring 195 is released and the carrier 180, which has been advanced, returns to its initial position while being disengaged from the gear 192 of the cover 190, thereby being in a free-rotation state.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An tiltable double-layered fabric blind comprising:

a double-layered fabric, composed of transparent front and rear sheets and a plurality of opaque spacer veins having a letter of "S" in section, with a horizontal bar mounted to a lower end of the fabric;

a rotator having a coupling pipe and a driving body mounted to one side of the coupling pipe, the coupling pipe being formed with a cylindrical pipe and combined with the double-layered fabric in such a manner that the spacer veins of the double-layered fabric are stretched in a horizontal posture and upper ends of the front and rear sheets are fixedly attached to opposite sides of the circumference of the coupling pipe;

an angle regulator having a rotating pipe mounted behind the rotator and a rotating body mounted to one side of the rotating pipe, the rotating pipe having a friction member, which makes one layer of the double-layered fabric brought into close contact with the circumference thereof and draws up the one layer;

a connection plate having a protrusion, which is coupled to center holes of the rotator and the angle regulator; and control cords mounted on one side of the rotator and the angle regulator.

2. The tiltable double-layered fabric blind according to claim 1, wherein the friction member is configured such that the outer circumference of the rotating pipe is directly applied or coated with silicone liquid or rubber-like member, to which one layer of the double-layered fabric closely adheres so that the layer is drawn up without slippage.

3. The tiltable double-layered fabric blind according to claim 1, wherein the rotating body comprising:

a fixing body having a fixing hole provided on one outer surface, to which a leaf spring is fixedly mounted, a center fixing protrusion shaft, to which a spring is mounted in a leading side, and a guide plate, in which a control cord outlet hole is formed thereon;

an operating plate mounted inside the guide plate of the fixing body, wherein the control cord is wound around the outer circumference of the operating plate, and a fastening portion, reinforcing steps of which are symmetrically formed on an inner circumference thereof, is integrally formed on a front surface of the operating plate;

a fixing ring inserted into the fastening portion and having opposite fixing steps with cut recesses;

a spring having an engaging step, which is fitted into the cut recess of the fixing ring;

a cover plate 165 installed on the front surface of the operating plate and having a center hole;

a carrier inserted into the center hole of the cover plate and mounted in a manner as to come into contact with the reinforcing step of the fastening portion and having a center insertion hole, through which the fixing protrusion shaft is inserted, a gear provided on the front surface, and a coupling groove provided on the rear surface with an inclined surface formed on one side; and a cover engaged with the gear of the carrier and having a center insertion hole and a gear formed on the rear surface thereof.

* * * * *